US008695513B2

(12) United States Patent
Figueras Mitjans

(10) Patent No.: US 8,695,513 B2
(45) Date of Patent: Apr. 15, 2014

(54) FOLDING READING DESK

(75) Inventor: Jose Figueras Mitjans, Llica d'Amunt (ES)

(73) Assignee: Figueras International Seating, S.L., Llica d'Amunt (Barcelona) (ES)

( * ) Notice: Subject to any disclaimer, the term of this patent is extended or adjusted under 35 U.S.C. 154(b) by 33 days.

(21) Appl. No.: 12/885,024

(22) Filed: Sep. 17, 2010

(65) Prior Publication Data

US 2011/0067607 A1 Mar. 24, 2011

(30) Foreign Application Priority Data

Sep. 18, 2009 (ES) ..... 200901869

(51) Int. Cl.
*A47B 3/00* (2006.01)
*A47B 23/00* (2006.01)

(52) U.S. Cl.
USPC ..... 108/115; 108/42

(58) Field of Classification Search
USPC ..... 108/1, 40, 41, 42, 48, 33, 115, 44
See application file for complete search history.

(56) References Cited

U.S. PATENT DOCUMENTS

| | | | | | |
|---|---|---|---|---|---|
| 1,457,751 | A * | 6/1923 | Roberts | 108/173 |
| 1,560,962 | A * | 11/1925 | Agee | 108/37 |
| 3,583,760 | A * | 6/1971 | McGregor | 297/145 |
| 5,050,929 | A * | 9/1991 | Gueringer et al. | 297/145 |
| 5,927,799 | A * | 7/1999 | Tornero | 297/145 |
| 5,974,984 | A * | 11/1999 | Mitjans | 108/150 |
| 6,132,019 | A * | 10/2000 | Kim et al. | 312/223.2 |
| 6,520,091 | B1 * | 2/2003 | Dettmers | 108/42 |
| 7,721,657 | B2 * | 5/2010 | Carstensen | 108/40 |
| 7,798,072 | B2 * | 9/2010 | Becker et al. | 108/42 |
| 7,874,614 | B2 * | 1/2011 | Figueras Mitjans | 297/145 |
| 2003/0047120 | A1 * | 3/2003 | Dettmers | 108/42 |
| 2006/0220425 | A1 * | 10/2006 | Becker et al. | 297/188.16 |
| 2007/0227407 | A1 * | 10/2007 | Cartensen | 108/33 |
| 2010/0326331 | A1 * | 12/2010 | St. Louis | 108/44 |

* cited by examiner

*Primary Examiner* — Darnell Jayne
*Assistant Examiner* — Timothy M Ayres
(74) *Attorney, Agent, or Firm* — Lucas & Mercanti, LLP

(57) ABSTRACT

A folding reading desk formed by a support structure with two boards, with an intermediate cavity in-between wherein a worktop board can be introduced and extracted, wherein said worktop board is coupled, in a sliding assembly with a braking system, to a board arranged in the mentioned intermediate cavity between the facing boards.

4 Claims, 8 Drawing Sheets

FOLDING READING DESK

This application claims the priority of the Spanish application no. P200901869, filed Sep. 18, 2009, which is incorporated by reference herein.

FIELD OF THE ART

The present invention relates to the conditioning of the seating places of the attendees in congress halls, conference rooms and places of similar activities, proposing a reading desk structured with embodiment features making it advantageous for those applications.

STATE OF THE ART

In congress halls, conference rooms and other places of similar activities, it is usual to fit out the seating places of the attendees with a desk allowing the user to support papers, documents or objects.

In the seats of attendees, which are normally arranged in a distribution of rows in front of the speaker's post or a point on which the attendees must focus their attention, the solution of incorporating folding boards in an assembly on the armrest structures of the seats is known, which is generally uncomfortable due to the movement limitations and the unease caused to the users of the seats.

Another known solution consists of arranging boards in a folding assembly on the backrest of the seats, for the use by the users of the seats located behind it, which has an application drawback due to the fact that the seats are usually placed in a staggered arrangement and in a stepped situation in the successive rows, such that the backrest of the seats does not exactly face the respective seats of the row located behind it.

OBJECT OF THE INVENTION

According to the invention, a reading desk is proposed, with a structural embodiment providing highly advantageous functionality features for the mentioned application in the seating places of attendees, solving in a practical manner the drawbacks of conventional arrangements.

The reading desk object of the invention is made up of a support structure formed by two legs, between which there are arranged two facing boards which determine a cavity in which a worktop board of the desk can be introduced and extracted, there being inside the cavity a central board in which the worktop board is assembled by means of a sliding system and a braking system.

The sliding system is made up of a guide fixed on the central board of the support structure and a sliding carriage on said guide which is fixed to a securing support articulated on the worktop board.

The braking system consists of a rack fixed on the central board of the support structure and a pinion associated with a rotating braking system which is fixed on the securing support articulated to the worktop board.

A desk is thus obtained which allows the sliding of the worktop board between a vertical concealment position inside the cavity of the support structure and an extracted position, in which said worktop board can be placed in a horizontal or slightly inclined manner, by means of the rotation with respect to the articulation on the securing support, the braking system exerting a retention of the movement in the sliding towards the inside of the cavity of the support structure, such that it prevents a fall with an abrupt stop blow in said movement.

The desk thus formed is easy to install in any place, both in an independent manner and in relation to seats, for the use by the users of said seats, without any structural dependence either of the seat itself or of the other seats, such that the arrangement of the desk does not affect or condition the distribution of the seats in any relative position between them.

The structural formation of this desk furthermore determines that in the folded position the worktop board is completely concealed inside the support structure, whereby a very suitable aesthetic appearance of the desk in that folded position is achieved.

Therefore, the proposed desk has truly advantageous features, acquiring its own identity and a preferred character for the application for which it is intended.

DETAILED DESCRIPTION OF THE INVENTION

Figure 1:
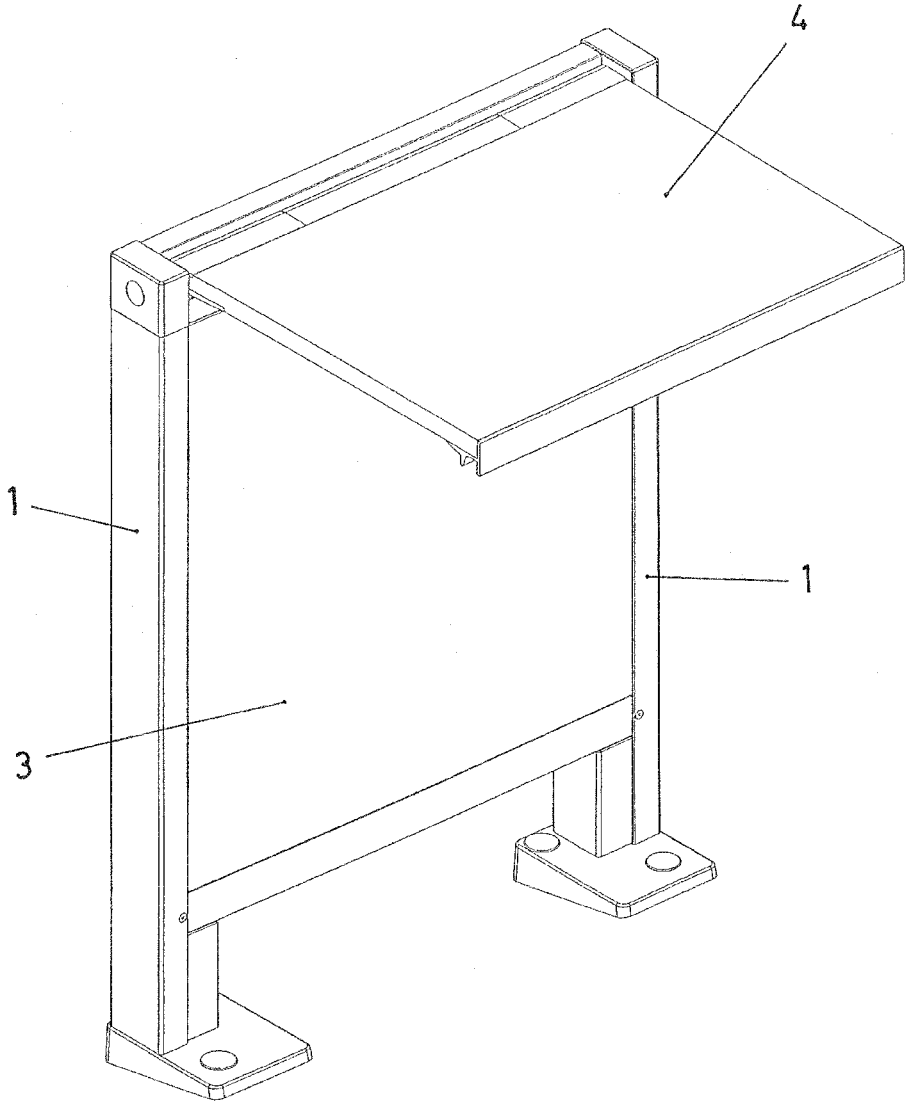
FIG. 1 shows a perspective view of the proposed reading desk, in a unfolded use position.
Figure 2:
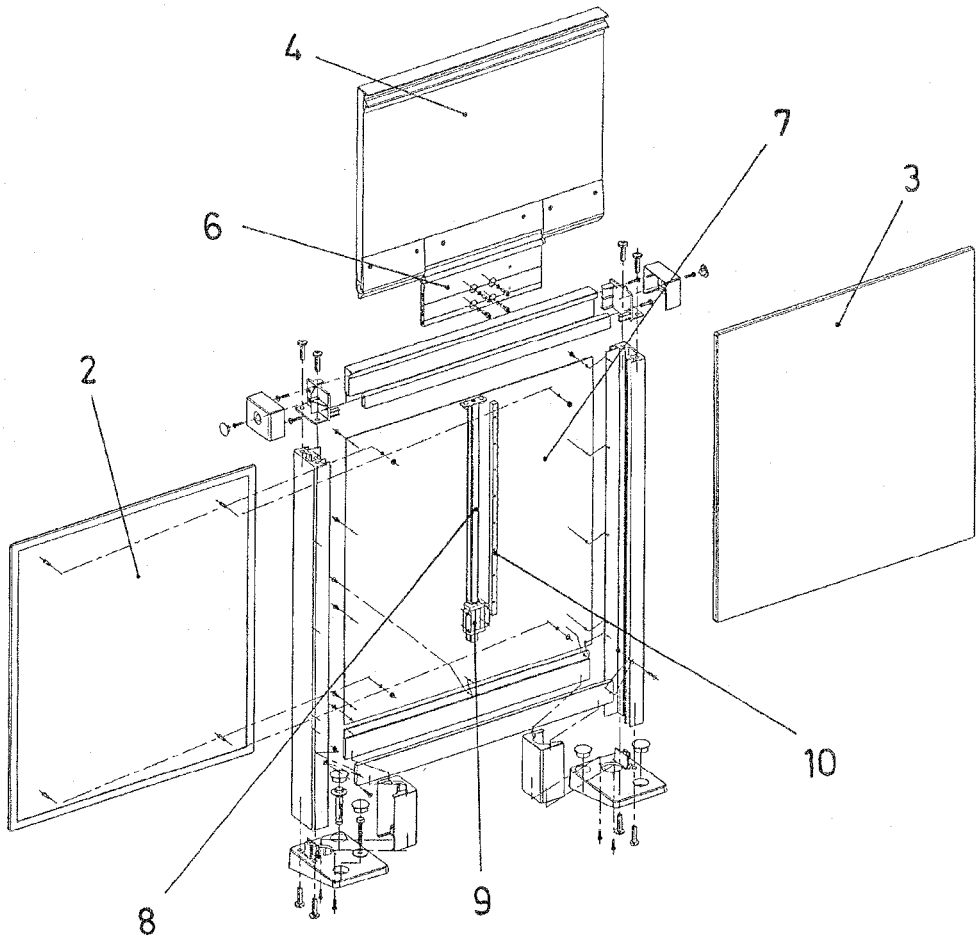
FIG. 2 is an exploded perspective view of the structural assembly of the desk.

The object of the invention relates to a reading desk which is applicable to any place, both in an independent manner and in relation to seats, in congress halls, conference rooms or any place of similar activities.

The proposed desk comprises a support structure which is made up of two legs (1), between which there are arranged two facing boards (2 and 3), which determine a cavity in which a worktop board (4) can be introduced and extracted.

Said worktop board (4) is coupled in an articulated manner, by means of a shaft (5), to a support (6), through which it is joined in an assembly, by means of a sliding system and a braking system, to a central board (7) arranged inside the cavity comprised between the facing boards (2 and 3) of the support structure.

The sliding system is made up of a guide (8) which is fixed on the central board (7) of the inside of the support structure, and a carriage (9) which is coupled in a sliding assembly on said guide (8) and fixed on the support (6) of the worktop board (4).

Figure 3:
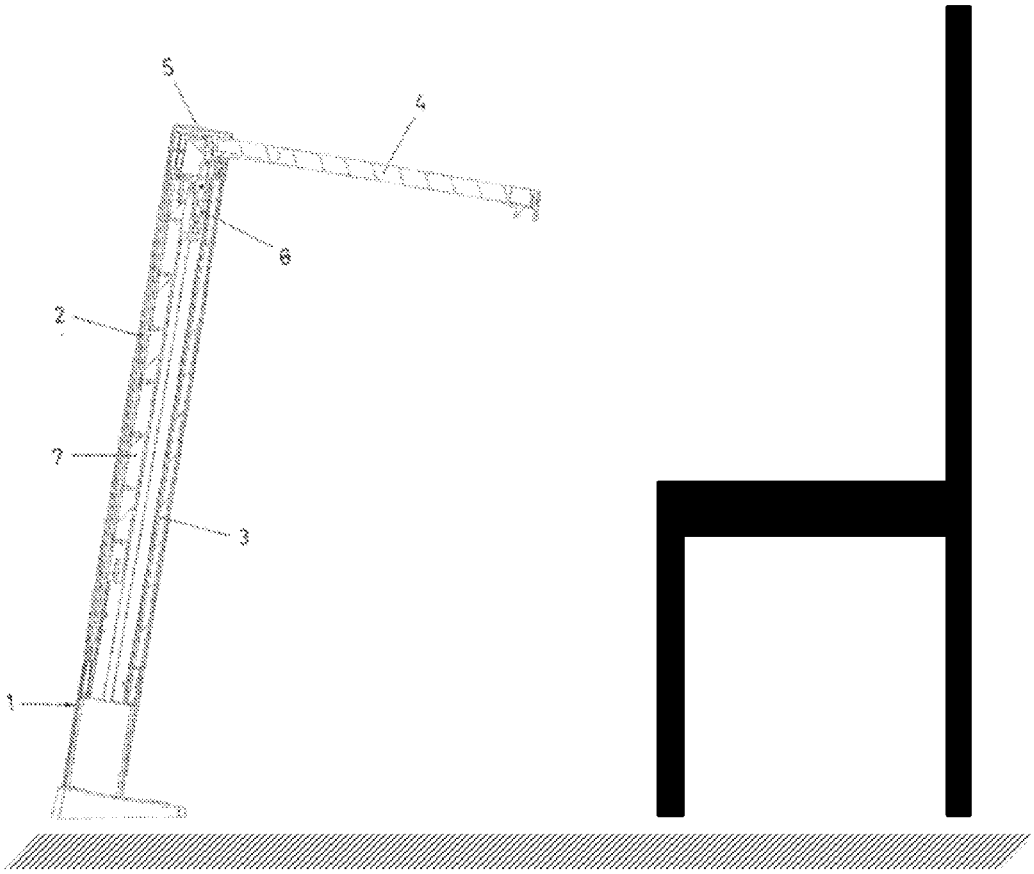
FIG. 3 is a sectioned side view of the desk in the unfolded use position.
Figure 4:
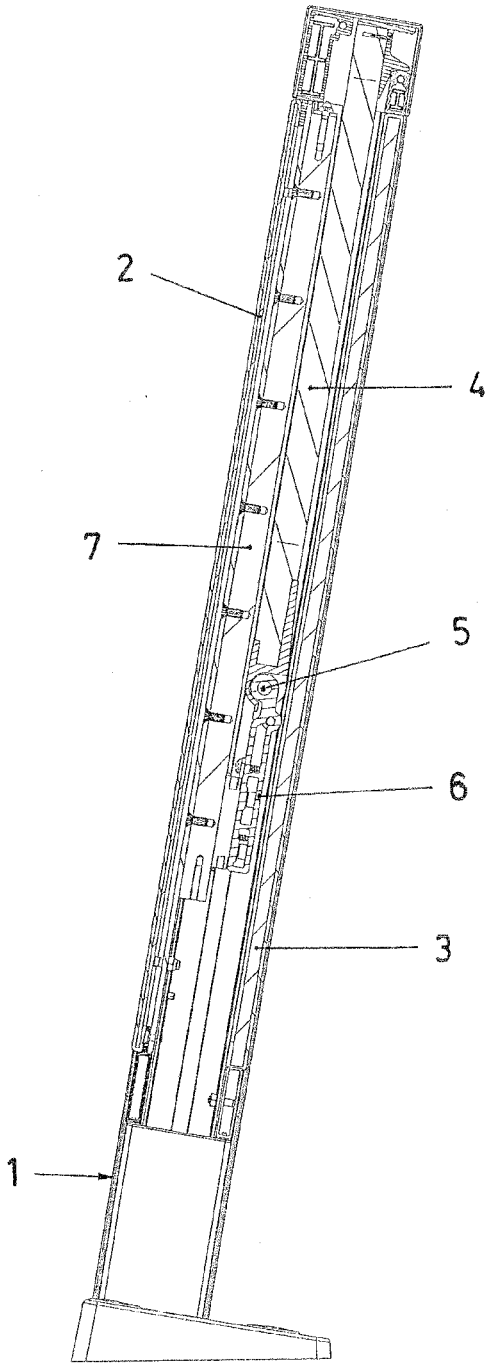
FIG. 4 is a sectioned side view of the desk in a folded position.
Figure 5:
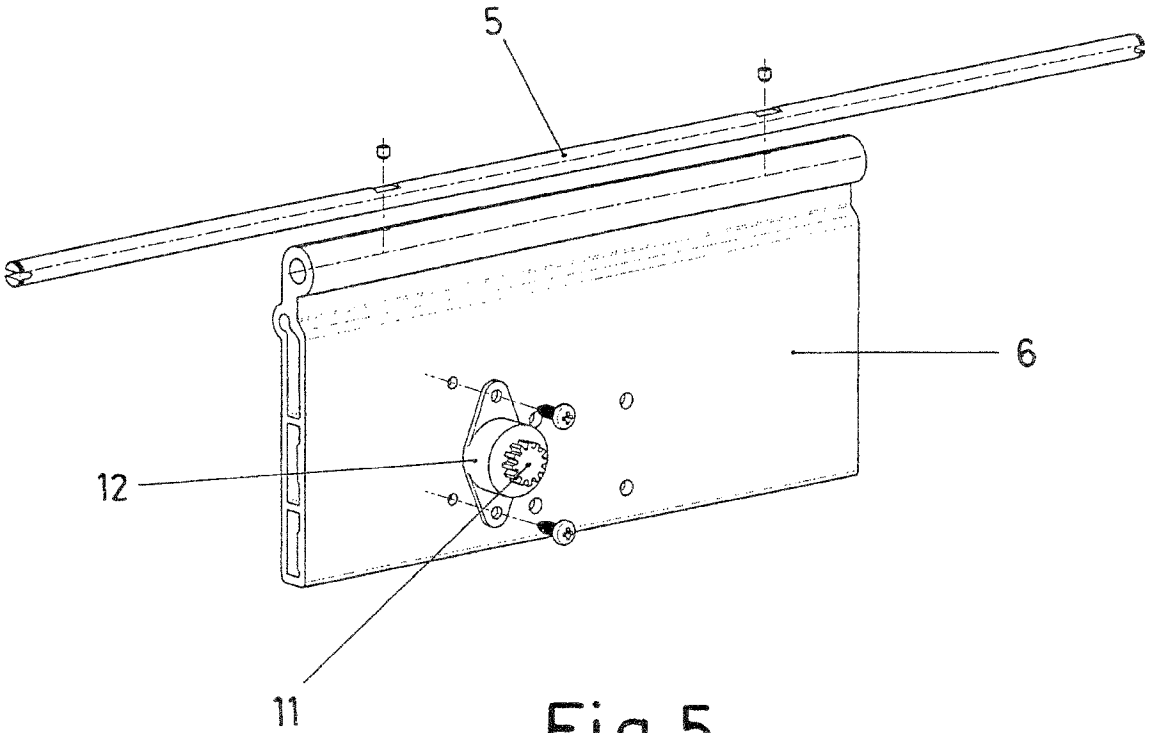
FIG. 5 is a perspective view of the securing support on which the worktop board of the desk is articulated.
Figure 6:
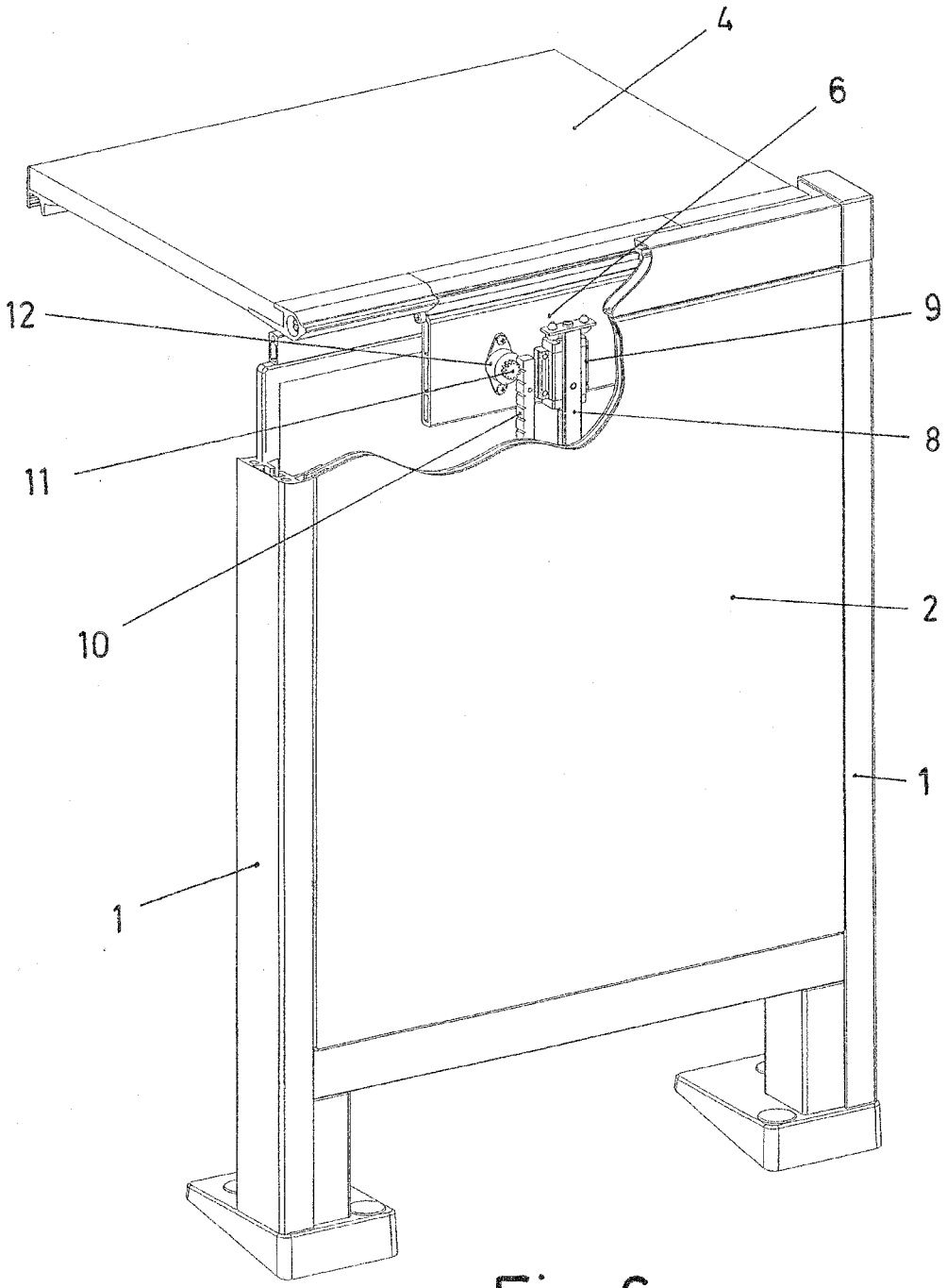
FIG. 6 is a perspective view of the unfolded reading desk seen by the rear part, with a partial cutaway of the support structure, in which the securing of the worktop board is observed.
Figure 7:
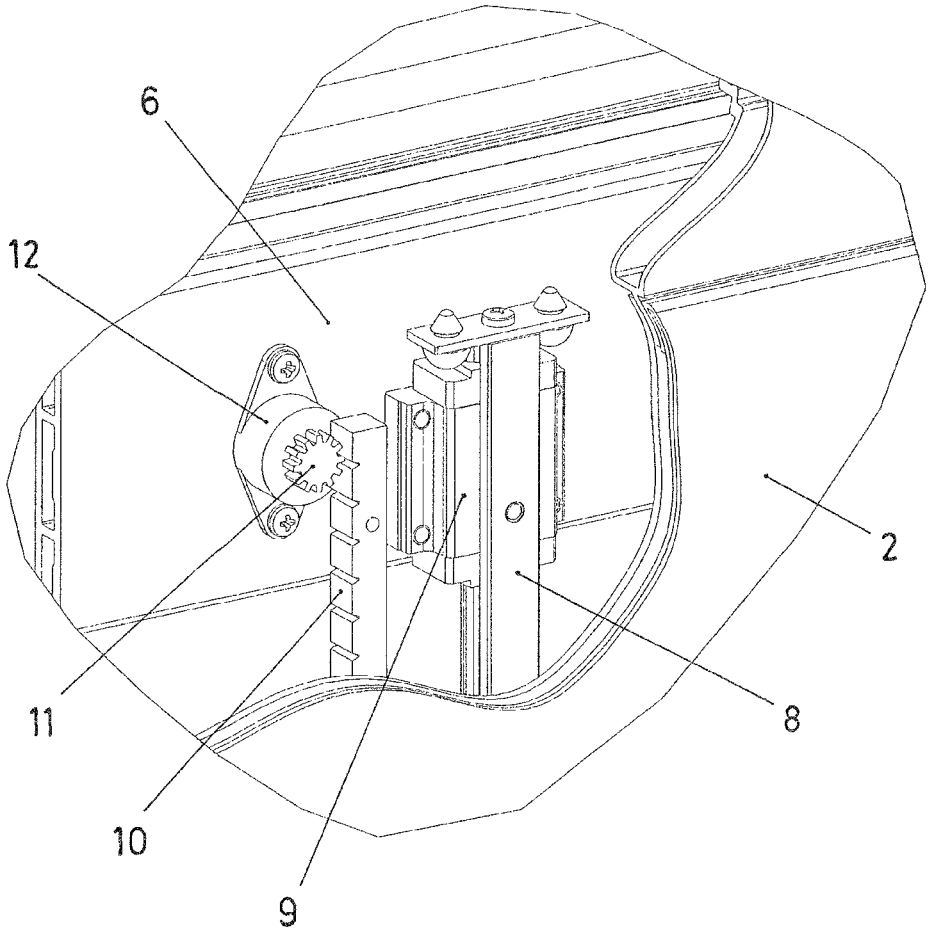
FIG. 7 is an enlarged detail of the securing of the worktop board of the desk.

Thus, the worktop board (4) can be pivoted by rotating on the articulation with respect to the support (6) to place said worktop board (4) in a horizontal or slightly inclined manner in the use position of the desk, as depicted in FIGS. 1 and 3, or to vertically introduce it in the cavity comprised between the facing boards (2 and 3) of the support structure, in a folded desk position, in which said worktop board (4) is completely concealed inside the support structure, as observed in FIG. 4.

In order to prevent, in the insertion in the housing cavity inside the support structure, the worktop board (4) from falling freely and abruptly colliding with the stop of the insertion, the sliding system is accompanied by a braking system comprising a vertical rack (10) fixed on the central board (7) of the support structure of the desk and, meshing with said rack (10), a pinion (11) associated with a rotating braking mechanism (12), which is fixed on the support (6) of the worktop board (4).

Thus, for the insertion of the worktop board (4) inside the support structure, it is enough to pivot said worktop board (4) to the vertical position, from which it falls by its own weight into the support structure, but in the falling movement, which is driven by the guiding system, the pinion (11) runs over the rack (10), the rotation of said pinion (11) being braked by the mechanism (12), whereby the worktop board (4) falls smoothly, reaching the lower stop without colliding abruptly.

Figure 8:
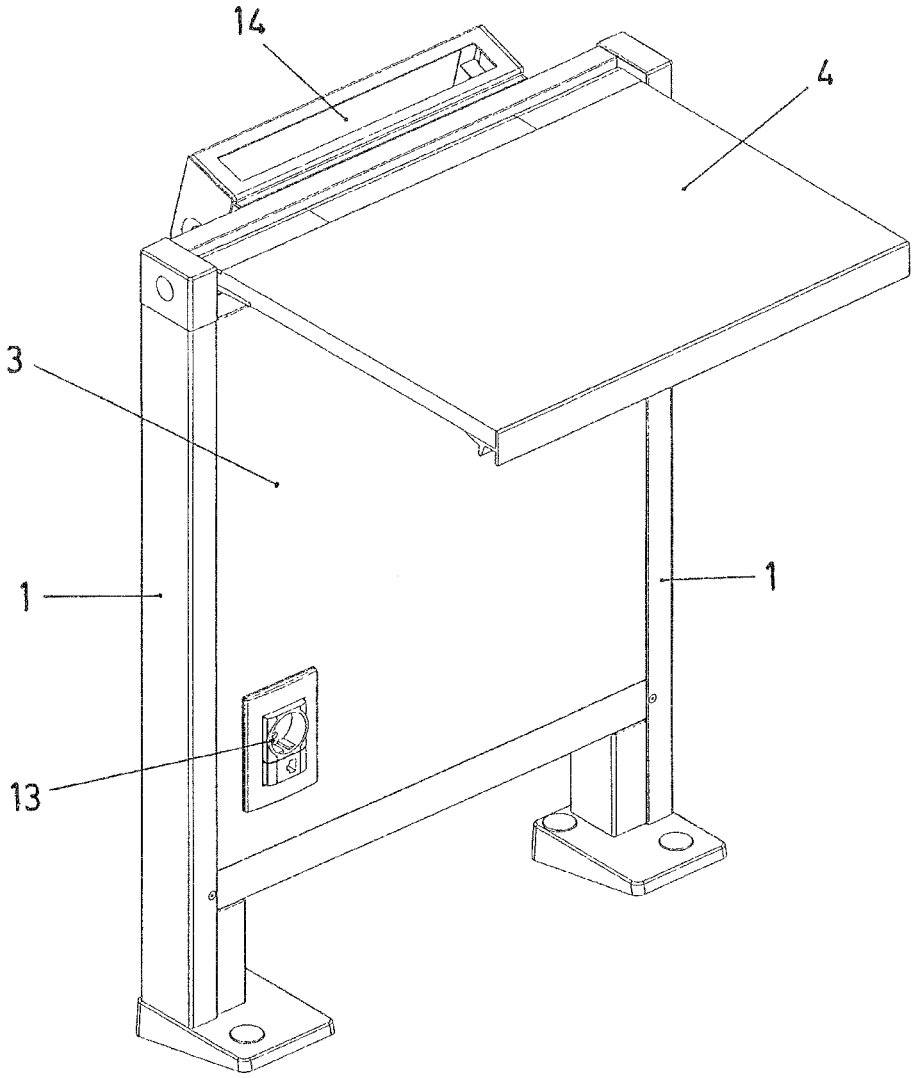
FIG. 8 is a perspective view of the reading desk in an unfolded position, according to an embodiment with electric and audio equipment.

The structural assembly of the reading desk, with the proposed arrangement for folding and unfolding the worktop board (4), according to the described manner, can be determined in a simple desk assembly, as in the embodiment of FIGS. 1 to 4, but likewise, without the concept of the assembly being altered, electric equipment with sockets (13) as well as voice and data transmission equipment (14) can be incorporated in the structural assembly, as in the embodiment of FIG. 8, the depicted embodiment being only a practical non-limiting example.

The invention claimed is:

1. A folding reading desk comprising:

a support structure comprising two legs;

two facing hoards mounted to and arranged between the two legs of the support structure, the two facing boards defining an intermediate cavity;

a central hoard mounted to the two legs and different from the two facing boards, the central board being arranged within the intermediate cavity between the two facing boards of the support structure;

a sliding system comprising a guide fixed on the central board and a carriage coupled to the guide;

a worktop board assembly comprising a worktop board, a shaft, and a support, wherein the carriage is fixed to the support, wherein the worktop board is adapted to rotate about the shaft, wherein the worktop board assembly is further adapted to descend vertically along the guide into the intermediate cavity; and a breaking system comprising a vertical rack fixed on the central board, a pinion, and a braking mechanism, wherein the pinion is adapted to rotate in response to a vertical descent of the worktop board assembly into the intermediate cavity, wherein the braking assembly is adapted to brake a rotation of the pinion, thereby braking a vertical descent of the worktop board assembly into the intermediate cavity.

2. The folding reading desk according to claim 1, wherein the worktop board is joined, by the shaft, to the support, wherein the worktop board is able to pivot between a horizontal position and a vertical position, by means of rotation about the shaft with respect to the support.

3. The folding reading desk according to claim 1, wherein the carriage is coupled in the sliding system to the guide.

4. The folding reading desk according to claim 1, wherein the pinion meshes with the rack, and runs over the rack in response to the vertical descent of the worktop board assembly into the intermediate cavity.

* * * * *